US005087168A

United States Patent [19]

McKinnon et al.

[11] Patent Number: 5,087,168

[45] Date of Patent: Feb. 11, 1992

[54] TILTING DEVICE FOR BACKHOE

[75] Inventors: James R. McKinnon, Oberlin; Dennis J. Cogan, Strongsville, both of Ohio; Joseph J. Riccardi, Bristol, Wis.

[73] Assignee: Versa-Hoe Sales & Leasing Inc., Cleveland, Ohio

[21] Appl. No.: 578,260

[22] Filed: Sep. 6, 1990

[51] Int. Cl.[5] ..... E02F 3/32

[52] U.S. Cl. ..... 414/687; 403/58; 212/238; 414/735

[58] Field of Search ..... 414/695, 695.5, 695.6, 414/695.7, 695.8, 687, 735; 901/28; 212/238, 255; 403/53, 58

[56] References Cited

U.S. PATENT DOCUMENTS

| | | | |
|---|---|---|---|
| 3,216,589 | 11/1965 | Walker | 414/695.7 X |
| 3,395,812 | 8/1968 | Arnold | 414/695.5 X |
| 3,657,831 | 4/1972 | Kant | 414/695 X |
| 3,724,693 | 4/1973 | Smalley | 414/695 |
| 3,848,756 | 11/1974 | Schaeff | 414/695 |
| 4,378,193 | 3/1983 | Schaeff | 414/695 |
| 4,500,250 | 2/1985 | Maurer et al. | 414/695.5 |
| 4,561,797 | 12/1985 | Aldridge | 403/58 |

FOREIGN PATENT DOCUMENTS

| | | | |
|---|---|---|---|
| 706051 | 5/1966 | Italy | 414/695.5 |

*Primary Examiner*—Robert J. Spar
*Assistant Examiner*—William M. Hienz

[57] ABSTRACT

A device is provided for tiltably connecting the boom section of a backhoe unit to the dipper section of the backhoe unit. The device includes a first member mountable to the dipper section so as to be rotatable about a first pivot axis transverse to the dipper section. The first member is connectable to the boom cylinder of the backhoe which pivots the first member about the first axis. A second member is provided which is attachable to the boom section of the backhoe. Respective coupling brackets extend from the first and second members to pivotably couple the first and second members and enable them to rotate about a second pivot axis generally orthogonal to the first pivot axis. Fluid cylinder mounting brackets extend from the first and second members adjacent the edges thereof to mount a pair of fluid cylinders in a diagonal crosswise configuration between the first and second members for tilting the first and second members relative to each other about the second axis.

10 Claims, 2 Drawing Sheets

TILTING DEVICE FOR BACKHOE

FIELD OF THE INVENTION

This invention relates generally to attachment devices which enable the dipper section of a backhoe to rotate about two non-parallel axes relative to the boom section of a backhoe.

BACKGROUND OF THE INVENTION

A conventional backhoe comprises a boom section which attaches to the back of a tractor or other support structure and supports a dipper section. The dipper section is hingedly connected to the boom section so as to be tiltable about an axis transverse to the boom section. Tilting is generally achieved through the use of a fluid cylinder, referred to as a "crowd" cylinder extending between the dipper section and the boom section of the backhoe.

A tool is generally mounted to the dipper section at the end opposite that which attaches to the boom section. The particular tool will depend on the application to which the backhoe is being put. The tool may be a bucket when the backhoe is used for digging. Alternatively the tool may be a pneumatic drilling or chiselling device for use in descaling furnace walls or the like.

While in some applications simply rotating the dipper section about the pivotal connection to the boom section provides adequate control of the tool, in certain applications it is desirable to be able to tilt the dipper section relative to the boom section about a further axis which may, for example, be orthogonal to the first axis.

Previously the tilting of the dipper section about the first axis has been achieved by providing a boom which is rotatable about an axis extending along its length. A disadvantage to such boom structures is their tendency to break, the amount of maintenance required and the limited amount of tilting force which such booms may exert. Another disadvantage with such devices is that a special boom is required in order to enable the dipper to rotate.

It is therefore an object of this invention to provide a device for attaching a dipper section of a backhoe to a conventional boom section while permitting the two sections to pivot relative to each other about two non-parallel axes. Further objects of this invention include providing such an attachment device which is of relatively simple and robust construction to provide good tilting force ("swing pressure") and require minimal maintenance.

Other features and advantages of the invention will be become apparent upon reviewing the description which follows.

SUMMARY OF THE INVENTION

A device is provided for connecting two structures and permitting relative movement therebetween about two non-parallel axes. The device comprises a first member having mounting means for pivotally mounting the first member to one of the structures and to allow the first member to rotate about a first axis, the first member further having connecting means for connecting the first member to a first tilting means and transmitting input from the first tilting means to the first member to rotate the first member about the first axis. The device further comprises a second member pivotally coupled to the first member to rotate about a second axis non-parallel to the first axis, the second member being attachable to the other of the two structures. The device still further comprises attachment means on the first and second members for attachment thereto of a second tilting means which extends between the first and second members for rotating the second member relative to the first member about the second axis.

DESCRIPTION OF THE DRAWINGS

A preferred embodiment of the present invention will now be described with reference to the attached drawings in which.

DESCRIPTION OF PREFERRED EMBODIMENTS

Figure 1:
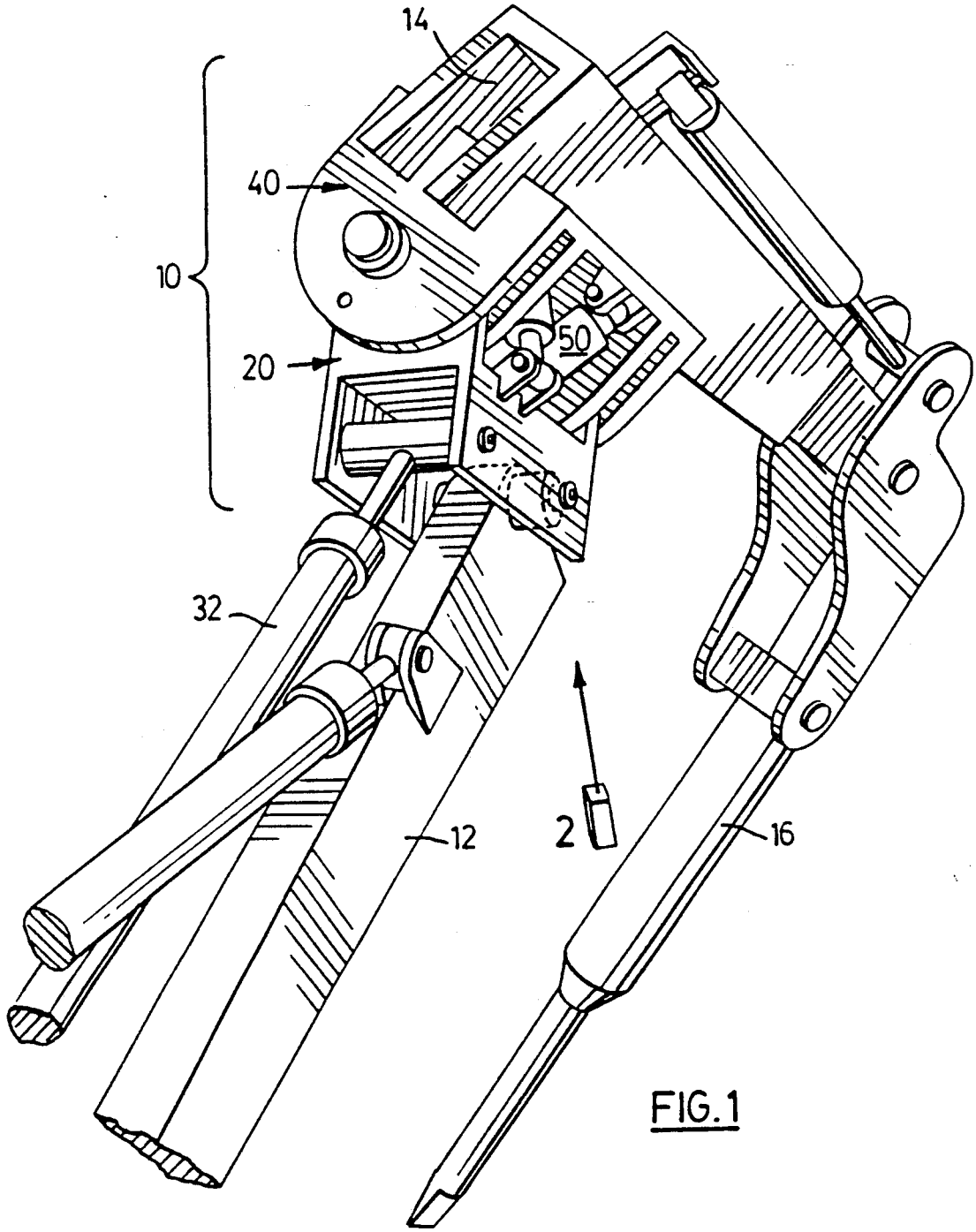
FIG. 1 is a perspective view of part of a backhoe with the device of the present invention attached thereto.
Figure 2:
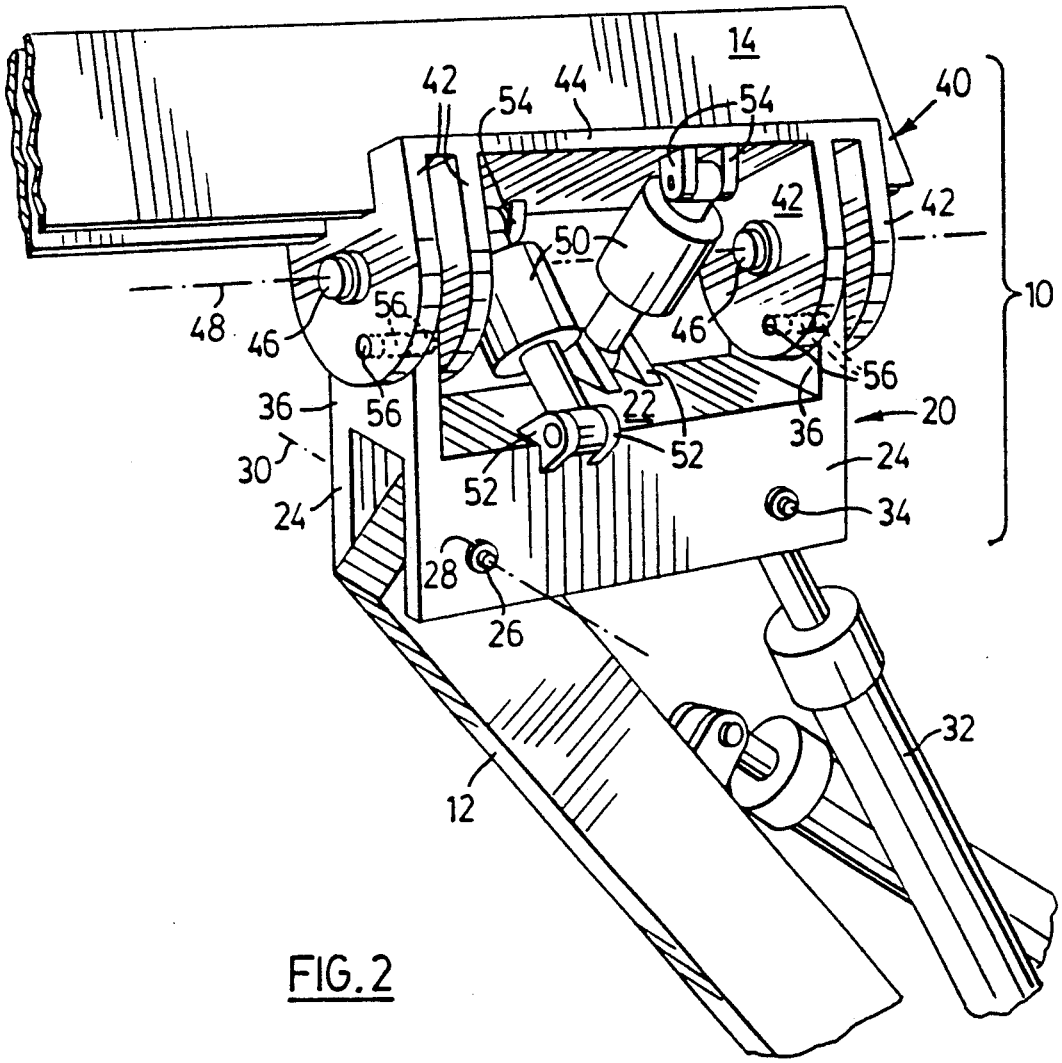
FIG. 2 is a perspective view of a device according to the present invention.

Referring to the drawings, the device of the present invention is generally indicated by Reference 10. The device 10 is shown connecting a boom section 12 of a backhoe (a first structure) to the dipper section 14 of the backhoe (a second structure). FIG. 1 further shows a chiselling tool 16 attached to the dipper section 14 of the backhoe.

The device 10 has a first member 20 which mounts onto the end of the boom 12. The first member has a generally rectangular base portion 22, from the edges of which depend spaced-apart parallel rectangular flanges 24. The end of the boom 12 is received within a space between the flanges 24 and retained therein by a pin 26 which extends through corresponding opposed openings in the flanges 24 and through the end of the boom 12. The openings in the flanges 24 are reinforced by generally cylindrical reinforcing bosses 28. The flanges and pin act as a mounting means for mounting the first member 20 to the end of the boom 12 to allow the first member 20 to rotate about a first axis 30 generally coaxial with the axis of the pin 26.

Tilting of the first member 20 relative to the boom section 12 is effected by a crowd cylinder 32 which acts as a first tilting means. The crowd cylinder 32 is connected to the first member 20 by a connecting means comprising a pin 34 extending through the flanges 24 and through one end of the crowd cylinder 32 in a manner analogous to the mounting of the first member 20 to the boom 12.

A second member 40 is shown attached to the dipper section 14 by suitable means such as welding. Other suitable means may include bolting of the second member 40 to the dipper 14. This may be desirable to make the second member 40 easy to remove for attachment to another dipper 14. Pairs of rounded-ended generally rectangular brackets 42 depend from a generally rectangular base portion 44 of the second member 40. A corresponding rounded-ended generally rectangular bracket 36 extends upwardly from each end of the base 22 of the first member 20 into the space between each pair of the brackets 42. Connecting pins 46 extend through each corresponding set of brackets 42 and 36 to couple the first member to the second member in a pin and clevis type of arrangement.

The first and second members, 20 and 40 respectively, are rotatable relative to each other about a second axis 48 coinciding with the axis of the pins 46. Such rotation is effected by a pair of fluid cylinders 50 extending diagonally through the space defined by the brackets 36 and 42, the base 22 of the first member 20 and the base portion 44 of the second member 40. Mounting brackets 52 and 54 are provided respectively on the base 22 of the first member 20 and the base portion 44 of the second member 40 for connection of the fluid cylinders 50. The mounting brackets 52 and 54 act as attachment means for connection of the second tilting means, namely the fluid cylinders 50, to the device 10.

The brackets 52 and 54 are provided adjacent both edges of the base 22 and base portion 44 respectively. Each of the fluid cylinders 50 extends from one edge of the first member to the edge of the second member which is opposite rather than directly above it. In this manner the fluid cylinders 50 may be considered as extending in "crossed over" or "opposite" diagonal directions relative to each other. The cylinders are connected so as to act in opposite directions with one cylinder 50 applying extensive force while the other cylinder 50 is applying retractive force. Although one cylinder may be adequate for the device 10 to work, two cylinders give more stability to the device.

Corresponding locking holes 56 are provided through the brackets 36 and 42. When the locking holes 56 are lined up, a pin (not shown) may be inserted therethrough to lock the first member 20 to the second member 40 to prevent pivoting about the second pivot axis 48. Such locking may be desirable to reduce undue wear on the tilting portion of the device when the tilting feature is not needed.

It is intended that the foregoing description be interpreted in an illustrative rather than restrictive sense. Variations to the specific structure described above may be apparent to persons skilled in the art of such attachment devices in adapting them to various applications. Such variations are intended to form part of the present invention insofar as they are within the spirit and scope of the claims set out below. For example, although the device of the present invention has been described as being mounted between the dipper and boom sections of a backhoe, to permit movement about two orthogonal axes, it will be appreciated that similar devices may be used in a similar manner to connect other structures to permit them to move relative to each other about two non-parallel axes. Furthermore, although fluid cylinders are shown as the tilting means in the preferred embodiment, it may be possible to use alternate tilting means such as a threaded rod and thread follower arrangement.

I claim:

1. A device for tiltably interconnecting a boom section and a dipper section of a backhoe, said boom section adapted to be attached to a support structure, said device enabling pivotal movement of said dipper section relative to said boom section about first and second non parallel pivotal axes, said device comprising: a first member having mounting means for pivotally mounting said first member to said boom section to be rotatable about said first pivotal axis said first pivotal axis extending generally transverse to said boom section, connecting means on said first member for connecting said first member to a crowd cylinder for pivoting said first member about said first pivotal axis;

a second member attachable to said dipper section;

two sets of coupling brackets extending between said first and second members for pivotally coupling said first and second members to permit relative pivotal movement about said second pivotal axis, each set comprising a first coupling bracket attached to said first member and a second coupling bracket attached to said second member;

and a pair of fluid cylinders acting through an opening defined between said first and second members and between said sets of brackets, to tilt said first and second members relative to each other about said second axis.

2. A device according to claim 1 wherein said mounting means for mounting said first member to said boom section and said connecting means for connecting said first member to said crowd cylinder comprise at least one flange extending from said first member, and having respective openings therein for receiving a pin extending from said boom section and a pin extending from said crowd cylinder.

3. A device according to claim 2 wherein said mounting means includes at least one pair of said flanges which are spaced apart to receive portions of said boom section and said crowd cylinder therebetween and wherein said openings in said flanges correspond to receive the respective pins extending from opposite sides of said portions.

4. A device according to claims 1, 2 or 3 wherein said second axis is generally orthogonal to said first axis.

5. A device according to claims 1, 2 or 3 wherein: said second axis is generally orthogonal to said first axis; and said sets of brackets extend from the first and second members at opposite ends thereof, the brackets of each set being connected by a pin extending therethrough.

6. A device according to claims 1, 2 or 3 wherein: said second axis is generally orthogonal to said first axis;

said sets of brackets extend from the first and second members at opposite ends thereof, the brackets of each set being connected by a pin extending therethrough; and said pair of fluid cylinders act between said first and second members extend, in orthogonal directions relative to each other.

7. A device as claimed in claim 1 wherein said coupling brackets are provided with corresponding locking holes through which a locking pin may be inserted to lock the coupling brackets of each set together to prevent pivotal movement about said second pivotal axis.

8. A device as claimed in claim 1 or 7 wherein said mounting means of said first member includes an opposed pair of flanges, each flange of said opposed pair extending along an edge of said first member, said flanges being spaced apart to accept an end of said boom section and an end of said crowd cylinder, and said flanges having corresponding opposed holes which accept respective coupling pins extending through said flanges and through respective ends of said boom section and said crowd cylinder.

9. A device as claimed in claims 1 or 7 wherein: said mounting means of said first member includes a pair of opposed flanges, each of said pair of opposed flanges extending along an edge of said first member, said flanges being spaced apart to accept an end of said boom section and an end of said crowd cylinder, said flanges having corresponding opposed holes which accept respective coupling pins extending through said flanges and through respective ends of said boom section and said crowd cylinder; and wherein said coupling brackets of each set are coupled by a pin extending therethrough in a pin and clevis arrangement.

10. A device according to claims 1, 2 or 3 wherein said pair of fluid cylinders for tilting said first and second members relative to each other act in opposing directions relative to each other.

* * * * *